US005612523A

United States Patent [19]

Hakamata et al.

[11] Patent Number: 5,612,523

[45] Date of Patent: Mar. 18, 1997

[54] VACUUM CIRCUIT-BREAKER AND ELECTRODE ASSEMBLY THEREFOR AND A MANUFACTURING METHOD THEREOF

[75] Inventors: Yoshimi Hakamata; Toru Tanimizu, both of Hitachi; Akira Osaka, Katsuta; Katsuhiro Komuro, Hitachi, all of Japan

[73] Assignee: Hitachi, Ltd., Tokyo, Japan

[21] Appl. No.: 206,670

[22] Filed: Mar. 7, 1994

[30] Foreign Application Priority Data

Mar. 11, 1993 [JP] Japan ..... 5-050776

[51] Int. Cl.[6] ..... H01H 33/66

[52] U.S. Cl. ..... 218/132; 218/128; 218/129; 29/880

[58] Field of Search ..... 200/144 R, 144 B, 200/264, 265, 266, 268; 218/22, 118, 123, 127, 128, 129, 130, 132, 146; 29/182.1, 182.2, 662, 874–880

[56] References Cited

U.S. PATENT DOCUMENTS

| | | | |
|---|---|---|---|
| 3,960,554 | 6/1976 | Gainer, Jr. | 75/200 |
| 4,629,839 | 12/1986 | Falkingham | 200/144 B |
| 5,099,093 | 3/1992 | Schels et al. | 200/144 B |
| 5,330,702 | 7/1994 | Kippenberg et al. | 419/28 |

FOREIGN PATENT DOCUMENTS

| | | | |
|---|---|---|---|
| 155322 | 9/1985 | European Pat. Off. | H01H 33/66 |
| 208271 | 1/1987 | European Pat. Off. | H01H 33/66 |
| 1805865 | 5/1970 | Germany | H01H 1/02 |
| 3130466 | 2/1983 | Germany | H01H 33/66 |
| 62-103928 | 5/1987 | Japan | H01H 33/66 |

*Primary Examiner*—Michael L. Gellner
*Assistant Examiner*—Michael A. Friedhofer
*Attorney, Agent, or Firm*—Fay, Sharpe, Beall, Fagan, Minnich & McKee

[57] ABSTRACT

A portion of a highly conductive metal member is infiltrated in voids of a porous high melting point metal member, and both the metal members are integrally joined to each other. An arc electrode portion 13 is formed of a high melting point area 11 in which the highly conductive metal is infiltrated in voids of the high melting point metal member. A coil electrode portion 14 is formed by hollowing out the interior of a highly conductive metal area 12 composed only of highly conductive metal and by forming slits 15 to 17 thereon. A rod 18 is hard-brazed on the rear surface of the coil electrode portion 14. With this electrode, it is possible to reduce the number of parts, and to omit the brazing portion between the arc electrode portion 13 and the coil electrode portion 14 for lowering the electric resistance and thereby the calorific value.

1 Claim, 3 Drawing Sheets

VACUUM CIRCUIT-BREAKER AND ELECTRODE ASSEMBLY THEREFOR AND A MANUFACTURING METHOD THEREOF

FIELD OF THE INVENTION

The present invention relates Lo a vacuum circuit-breaker, an electrode assembly for a vacuum circuit-breaker, and a manufacturing method thereof, and particularly to an electrode composed of an arc electrode portion and a coil electrode portion.

BACKGROUND OF THE INVENTION

In general, a vacuum circuit-breaker for a large current is constructed so that a pair of separable electrodes are disposed in a vacuum vessel, and rods connected to the rear surfaces of these electrodes extend to the outside of the vacuum vessel. Each pair of the above electrodes is composed of an are electrode portion on the front surface side and a coil electrode portion on the rear surface side which are opposed to each other. A current flows from one rod to the other rod by way of the coil electrode portion and the arc electrode portion of one electrode, and the arc electrode portion and the coil electrode portion of the other electrode. For breaking the current, any one of the rods is moved by an operating device so as to separate the arc electrode portion of one electrode from the arc electrode portion of the other electrode. At this Lime, an arc is generated between both the arc electrode portions. This arc is dispersed in the filiform manner by a magnetic field generated in the axial direction, that is, in parallel to the arc by the current flowing in the above coil electrode, to be extinguished.

Incidentally, for example, as disclosed in Japanese Patent Laid-open No. SHO 62-103928 (U.S. Pat. No. 4,704,506), the prior art electrode of this type which is composed of the arc electrode portion and the coil electrode portion is constructed as follows. The portion which contacts an arc in the arc electrode portion is formed by a machining step such as cutting a metal member excellent in withstand voltage performance and current-breaking performance, for example, one obtained by infiltration of a high conductive metal such as copper in voids of a high melting point metal such as chromium. Further, the coil electrode portion is formed by a machining step such as cutting inclined or circumferential slits on the side surface of a cylindrical member made from a high conductive metal such as copper, wherein the above slitted portion is adapted to allow a current to flow therethrough in the circumferential direction. The arc electrode portion, coil electrode portion, and the rod are electrically and mechanically connected to each other by hard brazing such as by silver brazing.

SUMMARY OF THE INVENTION

In the prior art electrode discussed above the arc electrode portion, the coil electrode portion and the rod are separately manufactured, and they are integrally assembled with each other by hard brazing. Accordingly; the prior art has the following disadvantages: fast, the number of parts is increased to thereby raise the cost; second the electric resistance of the brazing portion between the respective members is increased to thereby enlarge the calorific value during current-carrying, which requires taking an additional measure such as provision of a heat releasing portion, which thereby enlarges the size as a whole.

Accordingly, an object of the present invention is to provide an electrode for a vacuum circuit-breaker which is capable of reducing cost, lowering the electric resistance, reducing the size, providing a method for its manufacture, and further, providing a vacuum circuit-breaker including the same electrodes.

To achieve the above object, the present invention is characterized in that a part of a highly conductive metal member is infiltrated in voids or a porous high melting point metal member, and both the metal members are integrally joined to each other; the arc electrode portion is formed of a high melting point metal area in which the highly conductive metal is infiltrated in voids of the high melting point metal member; and the coil electrode portion is formed of a highly conductive metal area composed of only the highly conductive metal.

Further, the present invention is characterized by superpositioning a highly conductive metal member on a porous high melting point metal member formed by compressing and sintering of a high melting point metal powder; heating and fusing at least a part of the highly conductive metal member on the side connected with the high melting point metal member for infiltrating it in voids of the high melting point metal member, thereby integrally joining both the metal members to each other; machining a high melting point metal area in which the highly conductive metal is infiltrated in voids of the high melting point metal member to form the arc electrode portion; forming a highly conductive metal area composed of only the high conductive metal approximately in a cylindrical shape by hollowing the interior thereof through machining, and providing inclined or circumferential slits on the side surface of the cylinder, thereby forming the coil electrode portion; and connecting the rod on the rear surface of the coil electrode portion.

According to the present invention, since a part of a highly conductive metal member is infiltrated in voids of a porous high melting point metal member, and they are integrally joined to form one metal block, an arc electrode portion and a coil electrode portion are formed by this metal block. Accordingly, it is possible to reduce the number of parts, and omit the brazing portion between the arc electrode portion and the coil electrode portion resulting in the reduced electric resistance, thereby lowering the calorific value during current-carrying.

BRIEF DESCRIPTION OF THE DRAWINGS

Embodiments of the invention are now described by way of example with reference to the accompanying drawings, in which.

DETAILED DESCRIPTION OF THE PREFERRED EMBODIMENTS

Hereinafter, one embodiment of the present invention will be described with reference to FIGS. 1 to 4.

Figure 4:
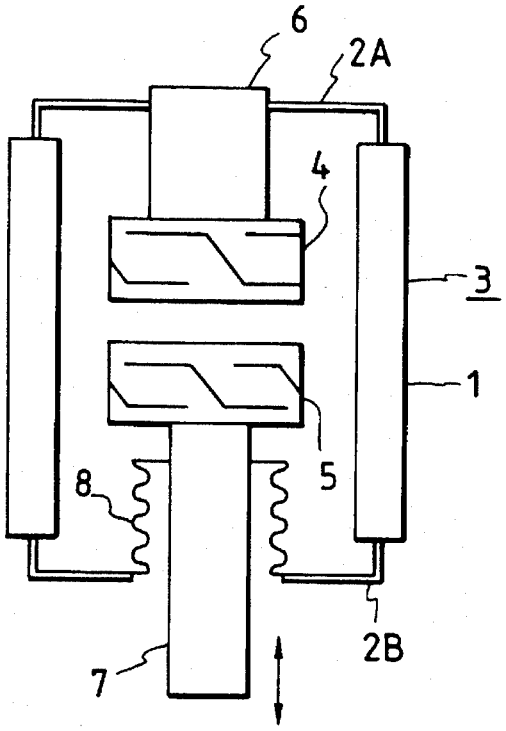
FIG. 4 is a sectional view of a vacuum circuit-breaker to which the present invention is applied.

FIG. 4 is a sectional view of a vacuum circuit-breaker to which the present invention is applied, wherein end plates 2A and 2B are mounted at both ends of an insulating cylinder 1, to form a vacuum vessel 3. A pair of a fixed electrode 4 and a movable electrode 5 are oppositely disposed in the vacuum vessel 3. Rods 6 and 7 are respectively connected to the rear surfaces of the electrodes 4 and 5 and extend to the outside of the vacuum vessel 3. A bellows 8 is mounted between the movable side rod 7 and the end plate 2B. The movable side rod 7 is connected to an operating device (not shown). The movable side rod 7 is moved by this operating device, so that the movable electrode 5 is electrically contacted with or separated from the fixed electrode 4.

Each of the electrodes 4 and 5 includes an arc electrode portion and a coil electrode portion, which are integrated with each other. In addition, the coil electrode portion may be included in at least one of both the electrodes 4 and 5.

Figure 2:
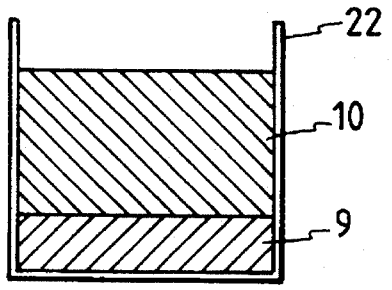
FIG. 2 is an explanatory view showing a method of manufacturing an electrode material of the present invention.
Figure 3:
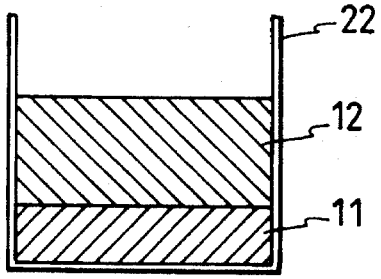
FIG. 3 is an explanatory view showing a method of manufacturing an electrode of the present invention.

The material for these electrodes is manufactured by such a method as shown in FIGS. 2 and 3. First, as shown in FIG. 2, a powder of a high melting point such as chromium or tungsten, or added with a powder of copper is filled in a vessel 22, which is compressed to obtain a specified porosity. This compressed powder is sintered, to form a porous high melting point metal member 9. A metal member 10 having a high conductivity such as copper or copper alloy is placed on the above high melting point metal member 9, and heated and fused, to be thus infiltrated in voids of the high melting point metal member 9. In this case, when the amount of the high conductive metal member 10 is larger than the volume of voids of the high melting point metal member 9, as shown in FIG. 3, there are formed a high melting point metal area 11 excellent in withstand voltage performance and current-breaking performance in which the highly conductive metal is infiltrated in the voids of the high melting point metal member 9, and a highly conductive metal area 12 formed of only the remaining highly conductive metal not infiltrated in the voids of the high melting point metal member 9, which are integrally joined to each other.

In addition, the infiltration of the highly conductive metal member 10 in the voids of the high melting point metal member 9 is performed by use of the dead weight of the highly conductive metal member 10; however, in the case that the infiltration is difficult, the highly conductive metal member 10 may be applied with a pressure from the upper side.

Further, in this embodiment, the highly conductive metal member 10 is wholly heated and fused; however, it may be heated and fused only on a necessary portion on the side contacting the high melting point metal member 9.

Figure 1:
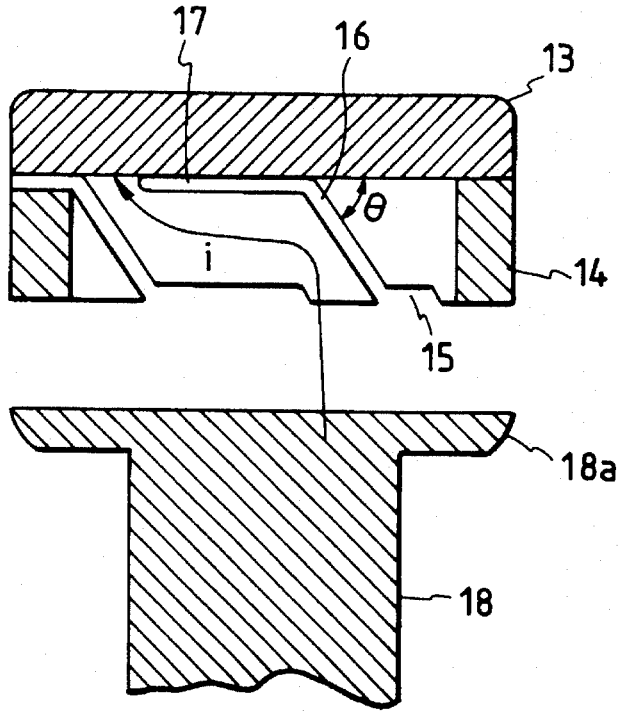
FIG. 1 is a sectional view of an electrode showing one embodiment of the present invention.

By use of one metal block composed of the high melting point metal area 11 and the highly conductive metal area 12 which are integrally joined to each other, as shown in FIG. 1, an arc electrode portion 13 and a coil electrode portion 14 are respectively formed of the highly melting point metal area 11 and the high conductive metal area 12 by a known prior art machining. Namely, the high melting point metal area 11 is cut in a specified shape, to form the arc electrode portion 13. Further, the highly conductive metal area 12 is formed approximately in a cylindrical shape by hollowing of the interior thereof through cutting, and providing circumferential slits 15 and 17 and inclined slits 16, to thus form the coil electrode portion 14. On the rear surface of the coil electrode portion 14, a rod 18 including a flange portion **18*a*** with the same diameter as that of the electrode is hard-brazed in the conventional manner.

In the electrode for a vacuum circuit-breaker having the above construction, a current i flows from the rod 18 along portions defined by respective slits 15 to 17 of the coil electrode portion 14 in the circumferential direction, to generate a magnetic field in the axial direction, that is, approximately in parallel to the are as a whole of the coil electrode portion 14.

Additionally, the number of the slits is suitably selected in consideration of the diameter of the electrode and the magnitude of the breaking current. Further, the shape of the stir is not limited to the above embodiment. For example, by making the inclination angle θ of the inclined slit 16 smaller, the same effect can be obtained even if the circumferential slits 15 and 17 are omitted.

Figure 5:
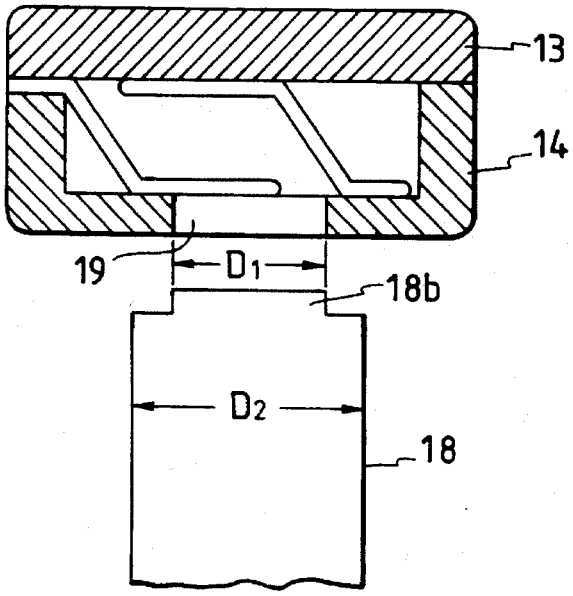
FIG. 5 is a sectional view of an electrode showing another embodiment of the present invention.

FIG. 5 shows another embodiment of the present invention. In this embodiment, the material for the electrode is the same as in the above embodiment, but the machining method for the coil electrode portion 14 is different. Namely, in the case that the highly conductive metal area 12 is formed approximately in the cylindrical shape by hollowing of the interior thereof through cutting, a diameter D1 of an opening portion 19 on the rear surface of this cylinder is made smaller than a diameter D2 of the rod 18. After that, slits are formed by cutting, and a small stepped portion **18*b* of the rod 18 is inserted in the opening portion 19**, to be hard-brazed in the conventional manner.

To provide the flange **18*a* on the rod 18 as described in the embodiment in FIG. 1, for example, it is required to strike the end portion of the god 18 and swell the end portion up to the diameter of the flange portion 19*a*, or to separately prepare the flange portion 18*a* and join it to the rod 18**, which takes a lot of labor.

However, in the case that the opening portion 19 with the diameter smaller than that of the rod 18 is formed on the rear surface of the coil electrode portion 14 as in this embodiment, only the small diameter stepped portion 18 is formed at the end portion of the rod 18 by cutting, which simplifies manufacturing.

Figure 6:
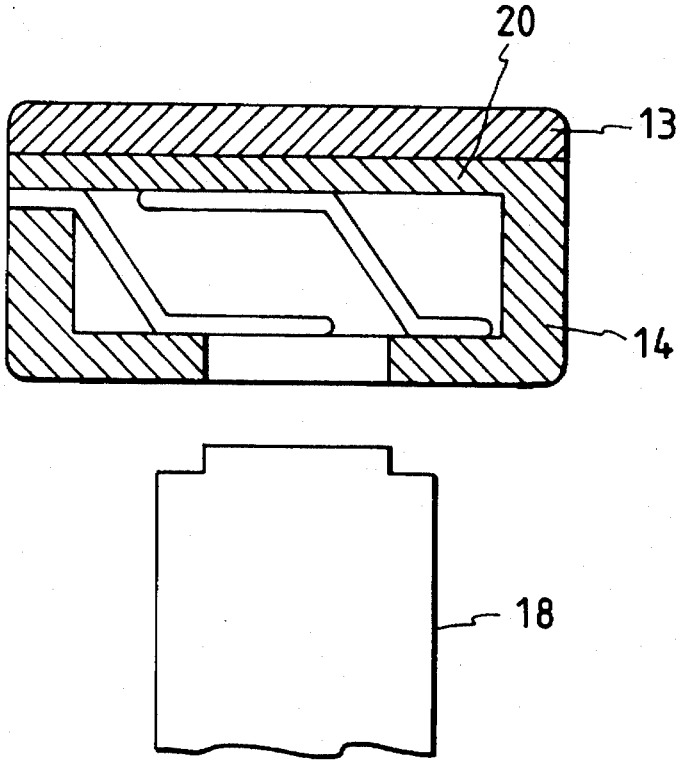
FIG. 6 is a plan view of an electrode showing a further embodiment of the present invention.

FIG. 6 shows a further embodiment of the present invention. In this embodiment, in the case that the highly conductive metal area 12 is formed approximately in a cylindrical shape by hollowing of the interior thereof through cutting, the portion contacted with the rear surface of the arc electrode portion 13 is made to remain by a suitable thickness as a backing electrode portion 20. The other construction is the same as in the embodiment in FIG. 5.

According to this embodiment, even in the case that the conductivity of the arc electrode portion 13 is low, a current is allowed to sufficiently flow from the circumferential portion of the coil electrode portion 14 to the central portion of the arc electrode portion 13 through the backing electrode portion 20 made from a highly conductive metal. Accordingly, it is possible to equivalently increase the conductivity of a current path directed from the circumferential portion of the coil electrode portion 14 to the central portion of the arc electrode portion 13.

In addition, in the case that the backing electrode portion 20 with high conductivity is provided on the rear surface of the arc electrode portion 13 particularly as in the embodiment of FIG. 6, an eddy current tends to flow at these portions, and a part of the axial magnetic field generated by the coil electrode portion 14 is cancelled by the eddy current, thereby causing a fear that the magnetic field necessary for ensuring the current breaking performance can not be obtained.

Figure 7:
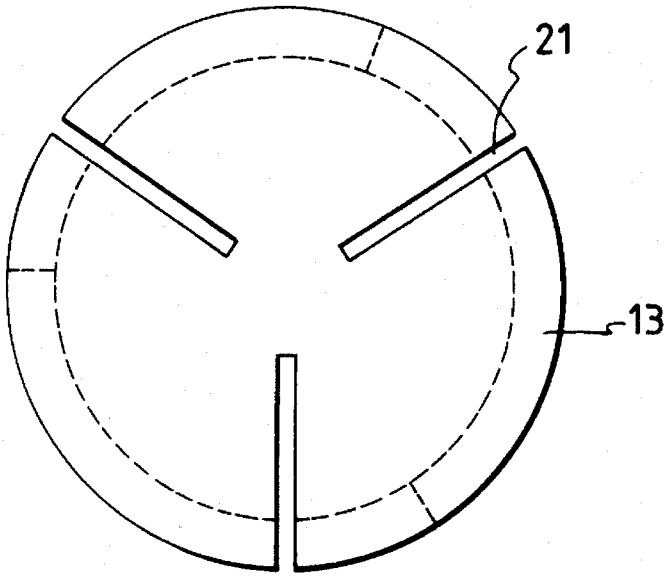
FIG. 7 is a cross-sectional view of the arc electrode portion according to one embodiment of the present invention.

In such a case, as shown in FIG. 7, a plurality of slits 21 radially extending from the center area of the electrode may be provided by cutting from the surface of the arc electrode portion 13 to the backing electrode portion 20. This makes it possible to reduce the generation of the eddy current, and hence to effectively utilize the axial magnetic field generated at the coil electrode portion 14.

In the prior art electrode in which the arc electrode portion, the coil electrode portion, the backing electrode portion and the like are integrally joined to each other by brazing, if the slits for reducing the eddy current as described above is provided, the brazing material at the joining portion is exposed from the front surface side, which causes a fear that the brazing material touches the arc. Consequently, since the brazing material is low in its melting point, and also is low in the withstand voltage performance and current breaking performance, the withstand voltage performance and the current breaking performance of the electrode is lowered. Accordingly, the prior art electrode cannot be provided with such slits for reducing the eddy current.

However, in the electrode of this embodiment, the arc electrode portion, the coil electrode portion, and the backing electrode portion are formed of an integral metal block, and accordingly, they are not brazed. As a result, even if the slits for reducing the eddy current are provided, it is possible to eliminate the lowering of the withstand voltage performance and the current breaking performance of the electrode due to exposure of the brazing material, and hence to freely provide the slits for reducing the eddy current.

Additionally, in the case that a vacuum circuit-breaker comprises the electrode construction as shown in each embodiment described above, there is a fear that the strength of the material of the coil electrode portion is weak and the slits are broken, which leads to the short-circuit. In this case, an insulating material with a large mechanical strength, or a spacer made from a metal with a electric resistance higher than the coil electrode portion such as stainless steel may be interposed between the arc electrode portion and the rod or between the backing electrode portion (if it exists) and the rod.

As described above, according to the present invention, part of a highly conductive metal member is infiltrated in voids of a porous high melting point metal member, and they are integrally joined to each other, to thus form one metal block; and an arc electrode portion and a coil electrode portion are formed of the one metal block. Accordingly, it is possible to reduce the number of parts and manufacture the electrode at a low cost, omit the brazing portion between the arc electrode portion and the coil electrode portion resulting in the reduced electric resistance, and reduce the calorific value in current-carrying without providing the heat releasing portion.

We claim:

1. A method of manufacturing an electrode assembly for a vacuum circuit-breaker, the electrode assembly having a front surface side with a front surface and a rear surface side with a rear surface and including an arc electrode portion positioned on the front surface side, a coil electrode portion positioned on the rear surface side for generating a magnetic field being approximately parallel to an arc caused by a current flowing through said coil electrode portion, and a rod connected to a rear surface of said coil electrode portion, said method comprising the steps of:

superpositioning a highly conductive metal member on a porous high melting point metal member formed by compressing and sintering of a high melting point metal powder;

heating and fusing at least a part of said highly conductive metal member on a side connected with said high melting point metal member for infiltrating said highly conductive metal member in voids of said high melting point metal member, thereby integrally joining both said metal members to each other;

machining a high melting point metal area in which said highly conductive metal is infiltrated in voids of said high melting point metal member to form said arc electrode portion;

forming a highly conductive metal area composed of only said highly conductive metal approximately in a cylindrical shape by hollowing an interior portion of said coil electrode portion through machining, and providing inclined or circumferential slits on a side surface of said cylindrically shaped highly conductive metal area, thereby forming said coil electrode portion; and connecting said rod on the rear surface of said coil electrode portion.

* * * * *